US007930806B2

(12) United States Patent
Funk

(10) Patent No.: US 7,930,806 B2
(45) Date of Patent: Apr. 26, 2011

(54) TIE KNOT MEMBER

(76) Inventor: Kelly Funk, Nanaimo (CA)

( * ) Notice: Subject to any disclaimer, the term of this patent is extended or adjusted under 35 U.S.C. 154(b) by 602 days.

(21) Appl. No.: 11/951,683

(22) Filed: Dec. 6, 2007

(65) Prior Publication Data

US 2009/0144945 A1 Jun. 11, 2009

(51) Int. Cl.
*A41D 25/00* (2006.01)
*A41D 25/02* (2006.01)

(52) U.S. Cl. ..... 24/66.9; 2/153

(58) Field of Classification Search ..... None
See application file for complete search history.

(56) References Cited

U.S. PATENT DOCUMENTS

| | | | | |
|---|---|---|---|---|
| 384,036 | A * | 6/1888 | Hellenberg | 24/66.9 |
| 2,170,707 | A * | 8/1939 | Chapel | 2/153 |
| 3,813,694 | A | 6/1974 | Ellin | |
| 4,000,523 | A | 1/1977 | Woods | |
| 4,489,443 | A | 12/1984 | Ellin | |
| 4,542,537 | A | 9/1985 | Plapp et al. | |
| 4,573,219 | A | 3/1986 | Hooten | |
| 4,977,624 | A * | 12/1990 | Safford | 2/153 |
| 5,035,002 | A | 7/1991 | Knight, Jr. | |
| 5,095,546 | A | 3/1992 | Jones | |
| 5,216,757 | A | 6/1993 | Dorkin | |
| 5,216,785 | A | 6/1993 | Graef | |
| 5,218,722 | A | 6/1993 | Vandenberg | |
| 5,235,704 | A | 8/1993 | Collins | |
| 5,245,708 | A | 9/1993 | Campelia et al. | |
| 5,313,810 | A | 5/1994 | Koven | |
| 5,353,438 | A | 10/1994 | Voiles | |
| 5,577,302 | A | 11/1996 | Bortle | |
| 5,715,538 | A | 2/1998 | Soll | |
| 5,815,836 | A | 10/1998 | Jacobson, II | |
| D411,575 | S | 6/1999 | LaBorde et al. | |
| D420,201 | S | 2/2000 | Azhar et al. | |
| D420,489 | S | 2/2000 | Walker | |
| 6,021,522 | A | 2/2000 | Najarian | |
| 6,094,746 | A | 8/2000 | Miller | |
| 6,131,200 | A | 10/2000 | McNamara | |
| 6,205,586 | B1 | 3/2001 | Jenkinds, Sr. et al. | |
| 6,216,275 | B1 | 4/2001 | Lee | |
| D454,422 | S | 3/2002 | Rush | |
| 6,421,835 | B1 | 7/2002 | Galante | |
| 6,427,245 | B1 | 8/2002 | Alcala | |
| 6,691,319 | B1 | 2/2004 | Simon | |
| 6,708,345 | B2 | 3/2004 | I | |
| 6,920,642 | B2 | 7/2005 | Dickens | |
| 6,983,961 | B2 | 1/2006 | Aduana, Jr. et al. | |

FOREIGN PATENT DOCUMENTS

| | | | |
|---|---|---|---|
| JP | 53084416 | U | 7/1978 |
| JP | 7003509 | A | 1/1995 |

* cited by examiner

*Primary Examiner* — Jack W. Lavinder
(74) *Attorney, Agent, or Firm* — Cameron IP

(57) ABSTRACT

There is provided a tie knot member for an elongated strip of fabric. The tie knot member includes a shell having a truncated, conical shape with a cardioid-like cross-section. The shell has a base end with a lower aperture. The shell has a top end with an upper aperture. The shell has a rear portion extending between the base end and the top end. The rear portion includes a cusp and a pivotable connector connecting the shell across the cusp. The pivotal connector is so positioned to retain the shape of the shell, whereby when the elongated strip of fabric is passed through the shell and the shell is spread at the top end, the upper aperture is enlarged and the lower aperture is reduced, thereby cinching the lower aperture against the elongated strip of fabric.

21 Claims, 5 Drawing Sheets

TIE KNOT MEMBER

BACKGROUND OF THE INVENTION

The traditional men's neck tie has been around for many years and has become the standard in most professional and business environments as part of the accepted dress code. One of the inherent issues with the traditional men's tie however is that unless a man learns to tie the tie correctly and do it on a regular basis, he never becomes skilled at tying ties. Some men therefore are either reluctant to wear a tie when it is called for or when it would be the appropriate dress-code for a particular environment.

Any person who ever wore a tie can at some point and time remember getting dressed up for an occasion and attempting to tie a neck tie and then having to re-tie it many times over to get just the right knot and length. This can become extremely frustrating. The combination of getting a neck tie adjusted to the correct length with the correct knot is clearly something that takes practice and is an art that many average people do not master because of lack of practice. Many persons will avoid having to tie a neck tie to prevent the potential embarrassment and the frustration of asking for help. Many persons also may not have immediate access to help at the time of fitting a tie so this may not even be an option.

For previously known devices such as the clip-on tie, people risked being humiliated by the possibility of a "clip-on" tie falling off and being ridiculed or laughed at for even wearing such a device. Clip-on ties were never really accepted as being anything other than a cheap imitation of a tie that persons would wear simply because they did not have the skills necessary to tie a conventional neck tie. Another inherent problem with such devices is that they were limited in available colors, designs, lengths and availability.

BRIEF SUMMARY OF THE INVENTION

Accordingly, one object of the present invention is to eliminate the embarrassment of having to ask for help to tie a tie along with eliminating the frustration of having to re-tie the tie over and over again in attempts to get the perfect combination of length and knot as discussed above.

In one aspect of the invention, there is provided a tie knot member for an elongated strip of fabric. The tie knot member includes a shell having a truncated, conical shape with a cardioid-like cross-section. The shell has a base end with a lower aperture. The shell has a top end with an upper aperture. The shell has a rear portion extending between the base end and the top end. The rear portion includes a cusp. The tie knot member includes a pivotable connector connecting the shell across the cusp. The pivotal connector is so positioned to retain the shape of the shell, whereby when the elongated strip of fabric is passed through the shell and the shell is spread at the top end, the upper aperture is enlarged and the lower aperture is reduced, thereby cinching the lower aperture against the elongated strip of fabric.

According to another aspect of the invention, there is provided a tie knot member for an elongated strip of fabric where the tie knot member includes a shell in the shape of two truncated, partial cones which are longitudinally connected. The shell has a base end with a lower aperture. The shell has a top end with an upper aperture. The shell has a front portion extending between the base end and the top end. The two truncated, partial cones tangentially connect at the front portion along a common wall. The shell has a rear portion positioned opposite of the front portion. A pivotable connector connects the two truncated, partial cones at the rear portion such that the shell has a cardioid-like cross-section. The pivotable connector is positioned to retain the shape of the shell and act as a pivot, whereby when the elongated strip of fabric is passed through the shell and the shell is spread at the top end, the upper aperture is enlarged and the lower aperture is reduced, thereby cinching the lower aperture against the elongated strip of fabric.

According to a further aspect of the invention, there is provided a combination tie and tie knot member for the tie. The tie has a flared portion and a neck portion. The tie knot member includes a shell. The shell has a truncated, conical shape with a cardioid-like cross-section. The shell has a base end with a lower aperture. The shell has a top end with an upper aperture. The shell has a rear portion extending between the base end and the top end. The rear portion including a cusp. The tie knot member includes pivotable connector connecting the shell across the cusp. The pivotal connector is so positioned to retain the shape of the shell, whereby when the flared portion of the tie is passed through the shell and the shell is actuated outwards at the top end and against the neck portion of the tie, the upper aperture is enlarged and the lower aperture is reduced, thereby cinching the lower aperture against the flared portion of the tie.

According to yet another aspect of the present invention, there is provided a tie apparatus for a wearer having a neck. The tie apparatus includes an elongated strip of fabric. The tie apparatus includes a cinching device for cinching the strip of fabric about the neck of the wearer. The cinching device includes a sheet-like flexible member having opposite edges. The flexible member is curved to form a truncated cone with an upper aperture and a lower aperture. The strip of fabric extends through the cinching device from the upper aperture to the lower aperture. The cinching device includes a pivotal connector operatively connecting the opposite edges of the flexible member together, whereby a force applied to spread the cinching device apart at the upper aperture causes the lower aperture to contract and cinch the cinching device about the strip of fabric.

BRIEF DESCRIPTION OF THE DRAWINGS

Referring to the drawings:

FIG. 8 is a rear, bottom perspective view of the tie knot member illustrated in FIG. 5 in the.

DESCRIPTION OF THE PREFERRED EMBODIMENTS

Figure 1:
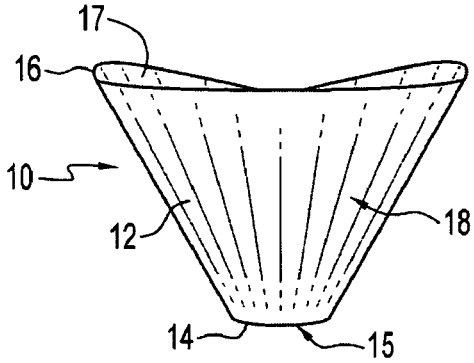
FIG. 1 is a front elevation view of the tie knot member according to one embodiment of the invention.

Referring to the drawings and first to FIG. 1, a tie knot member is illustrated as indicated by numeral 10. The tie knot member 10 also may be referred to as a cinching device. In this embodiment, the tie knot member 10 comprises a flexible member, in this case a shell 12 made of a flexible material. The shell 12 in this example is a resilient plastic although other materials could be used. The tie knot member 10 has a top end 16 with an upper aperture 17. The tie knot member has a base end 14 with a lower aperture 15. A front portion 18 extends between base end 14 and top end 16.

Figure 2:
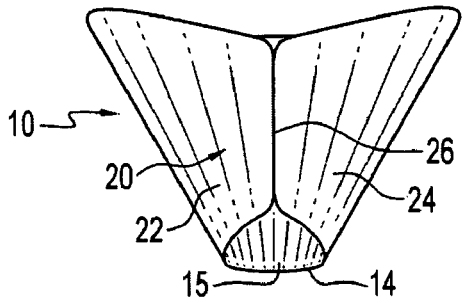
FIG. 2 is a rear elevation view of the tie knot member according to the embodiment of FIG. 1.
Figure 3:
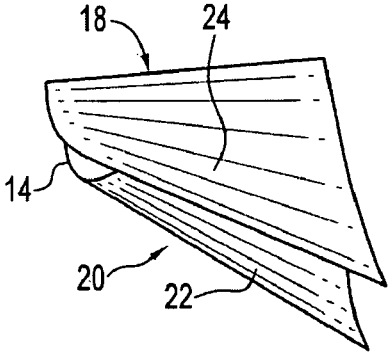
FIG. 3 is a side plan view of the tie knot member illustrated in FIG. 1.
Figure 4:
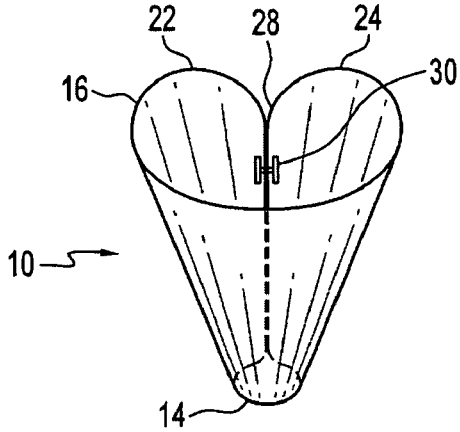
FIG. 4 is a front, top perspective view of the tie knot member illustrated in FIG. 1.

There is a rear portion 20 opposite the front portion 18, as illustrated in FIG. 2. The tie knot member 10 has cone members 22 and 24. Cone members 22 and 24 may be referred to as two truncated, partial cones, In this embodiment, the cone members abut adjacent to a slit 26. Each of the cone members is in the shape of a partial truncated cone, as best illustrated by FIGS. 3 and 4. The cone members 22 and 24 are tangentially connected by front portion 18.

Figure 5:
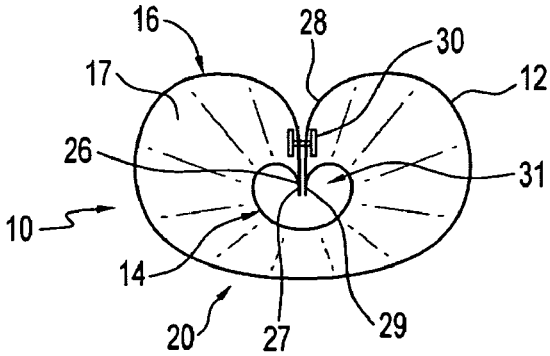
FIG. 5 is a top perspective view of the tie knot member illustrated in FIG. 1.

Referring to FIG. 5, the cone members 22 and 24 are so shaped as to provide the shell 12 of the tie knot member with a cardioid-like cross-section and a cusp 28. The cone member 22 and 24 are attached by a pivotal connector 30, as best illustrated in FIG. 5. In this example, the pivotal connector 30 is a rivet. Those skilled in the art will appreciate that the pivotal member may be a pin, a snap button, hook and loop fastener, or other fastener, a single staple, or other such connector. The pivotal connector 30 is adjacent to the slit 26. The pivotal connector 30 is so positioned as to retain the shape of the shell.

The pivotal connector 30 is adjacent to opposite edges 27 and 29 of the shell 12. The opposite edges 27 and 29 curl around and come together, forming a guiding member 31 inside the tie knot member 10.

Figure 11:
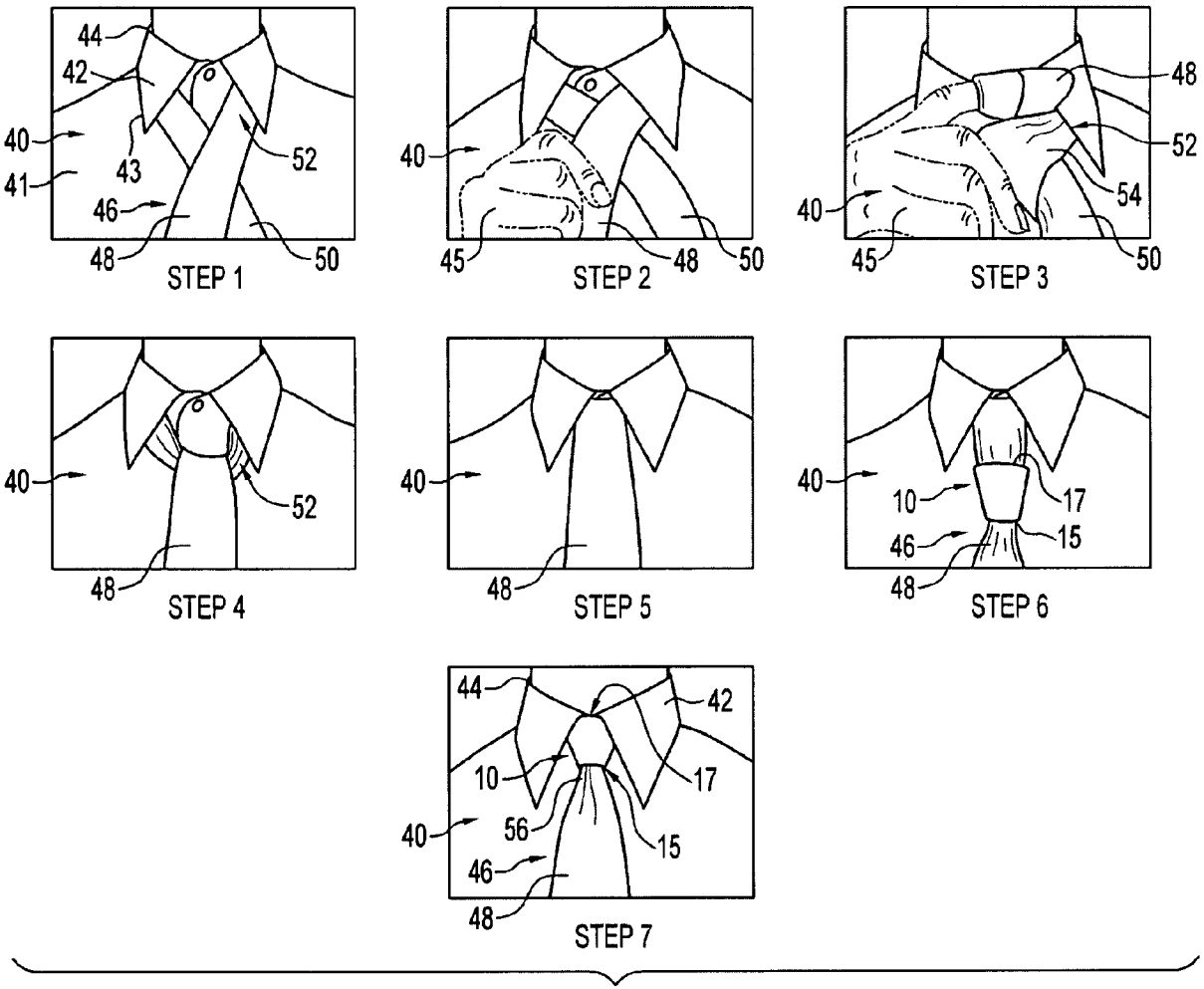
FIG. 11 is a series of partial elevation views of a person putting on a tie with use of the tie knot member illustrated in FIG. 1.

The tie knot member 10 may be used in conjunction with an elongated strip, in this case a tie 46, as illustrated at step 6 of FIG. 11. The lower aperture 15 and upper aperture 17 are so shaped as to receive the tie 46.

Figure 6:
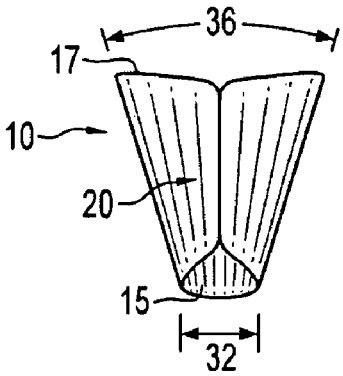
FIG. 6 is a rear elevation view of the tie knot member similar to FIG. 2 in a first mode.
Figure 7:
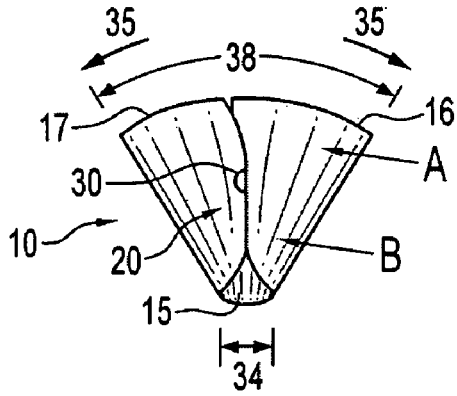
FIG. 7 is a rear elevation view of the tie knot member in a second mode.

In operation and referring now to FIG. 6, the tie knot member 10 is illustrated in a first, non-actuated mode. The lower aperture 15 has a diameter 32 and the upper aperture has a width 36. A force, as indicated by arrows 35, is applied outwardly by the wearer's fingers adjacent to the upper aperture 17 as illustrated in FIG. 7 to spread the shell 12 at its upper end 16 and achieve a second, actuated mode. The upper aperture 17 is then enlarged to width 38 and the lower aperture 15 is reduced to diameter 34. Put another way, the pivoting action around pivotal member 30 results in the restricting reaction at the lower aperture 15 of the member 10.

The position of the pivotal connector 30 is important. The goal is to have the pivotal connector 30 so positioned as to result in the upper aperture 17 spreading out readily. The upper aperture 17 should spread out so as to create the appearance of the elongated, flat shape of a traditional tie knot. The right amount of constricting at the lower aperture 15 is also important. If the restriction is too great, the tie knot member 10 may be too tightly connected to the tie 46, causing excessive bulging of the tie 46 at the lower aperture 15.

The pivotal connector 30 may be said to divide the cone members 22 and 24 into sections A and B as illustrated in FIG. 7. If section A is longer than section B, the cone members 22 and 24 behave as two levers in restricting the lower aperture 15. The closer the pivotal connector 30 is positioned towards the lower aperture 15, the longer is section A, the greater is this lever effect and the easier it is to have movement or spreading action at the upper aperture 17. This accordingly enhances the ability to regulate the restrictive action of the lower aperture 15. In this example, the location of the pivotal connector 30 is half way between the lower aperture 15 and the upper aperture 17, allowing for easier expansion or spreading movement of the upper aperture 17 and less movement or restrictive action at the lower aperture 14. Preferably, the pivotal connector 30 is located either halfway between the lower aperture 15 and upper aperture 17, or slightly closer to the lower aperture 15 than upper aperture 17.

Figure 8:
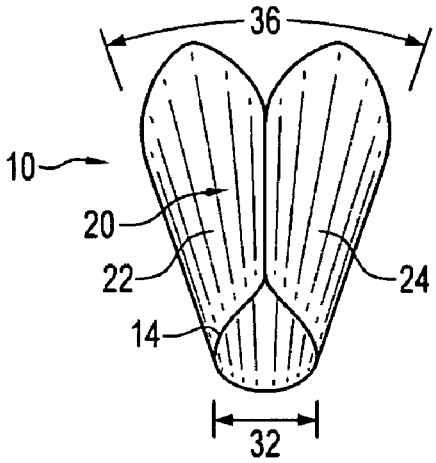
Figure 9:
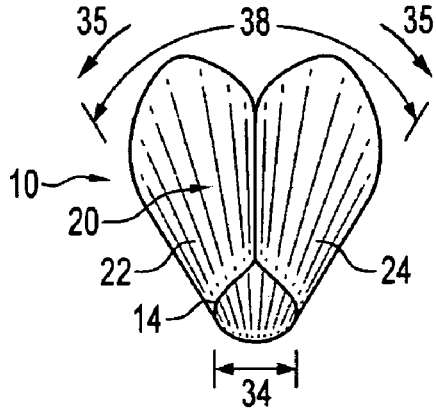
FIG. 9 is a rear, bottom perspective view of the tie knot member illustrated in FIG. 6 in the second mode.

The spreading and restrictive action is similarly illustrated from a rear perspective view in FIGS. 8 and 9. The first, non-actuated mode is illustrated in FIG. 8 and the second, actuated mode is illustrated in FIG. 9. The tie knot member 10 allows for the lower aperture 15 to be reduced in part because of its cardioid-like shape, in part because the tie knot member 10 is made of a flexible material, and in part because of the pivotal connector 30.

Figure 10:
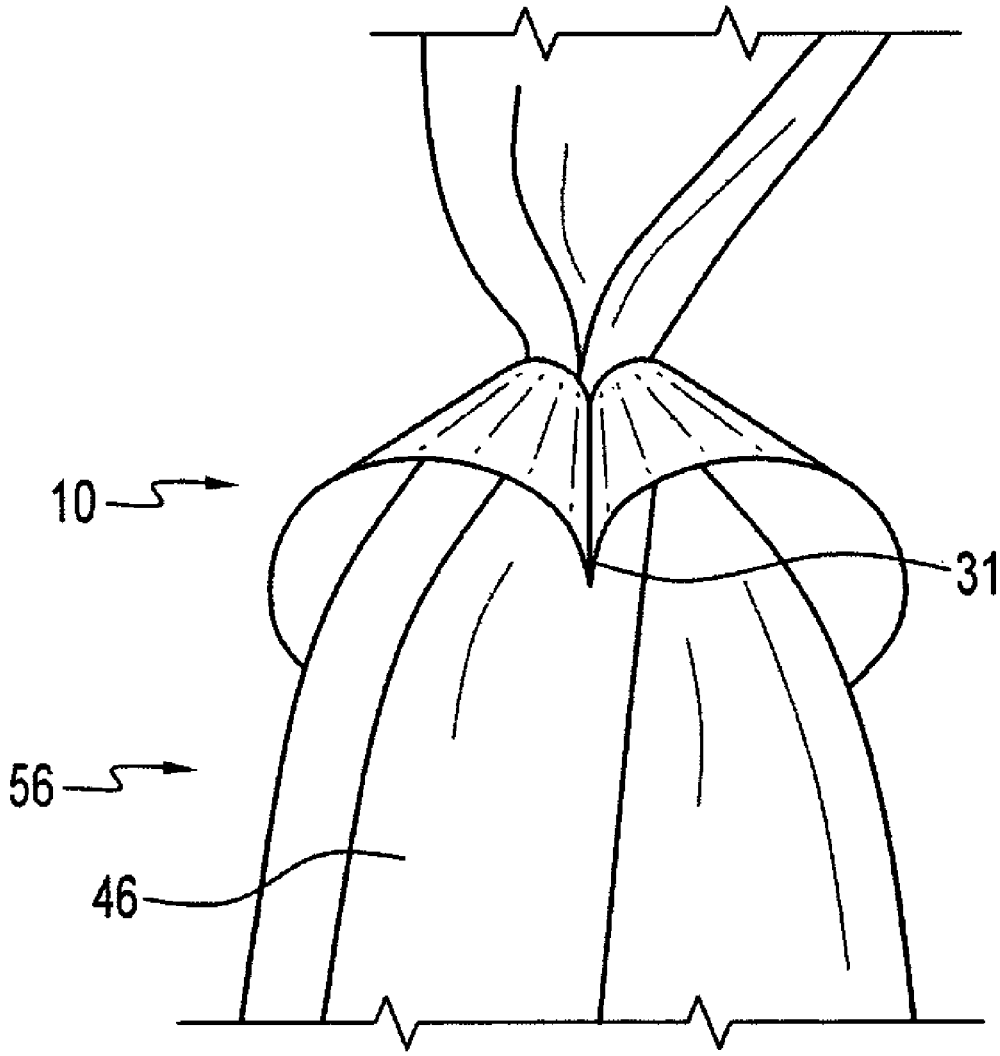
FIG. 10 is a top, rear perspective view of the tie knot member illustrated in FIG. 9 with a tie inserted therethrough.

The tie knot member 10 may thereby cinch the lower aperture 15 against an elongated fabric such as the tie 46, as illustrated in the tie apparatus 56 of FIG. 10. The guiding member 31 serves as a natural guide for the tie 46 due to the internal shape of the tie knot member 10. The guiding member 31 enables the tie 46 to be retained in a more desired shape or configuration while the tie knot member 10 slides up the length of the tie into position.

The steps for putting on the tie 46 with the tie knot member 10 are illustrated in FIG. 11. Step 1 illustrates a person 40 with a shirt 41 and collar 42. The collar 42 has a bottom 43 and a top 44. The tie 46 includes a flared portion 48, a slip portion 50 and a neck portion 52. In this step, the neck portion 52 of the tie 46 is wrapped around the shirt 41 underneath the collar 42. The flared portion 48 overlaps the slip portion 50. In step 2, hand 45 holds the flared portion 48. In step 3, the hand 45 tucks the flared portion 48 underneath the slip portion 50 and over top of the neck portion 52. A fold 54 is thereby formed. In step 4, the flared portion 48 is left to rest downwards from the perspective of the FIG. 11. In step 5, the neck portion 52 has been so adjusted as to snugly fit underneath collar 42.

In step 6, the flared portion 48 has been inserted through the tie knot member 10 which acts as a sleeve for the tie 46, allowing the flared portion 48 to pass through lower aperture 15 and upper aperture 17. At this stage, the tie knot member 10 remains in the first, non-actuated mode illustrated in FIGS. 6 and 8.

The tie knot member 10 is then positioned at the top 44 of the collar 42 and is actuated outwards, by the wearer's fingers for example, to the second, actuated mode illustrated in FIGS. 7 and 9. In this case, the upper aperture 17 is enlarged so as to abut the top 44 of the collar 42. This thereby acts to retain the tie knot member 10 in the actuated mode. The lower aperture 15 is reduced so as to cinch the flared portion 48 of the tie 46 and form dimple 56.

The tie knot member 10 and tie 46 may be removed by, for example, reversing the above steps.

Figure 12:
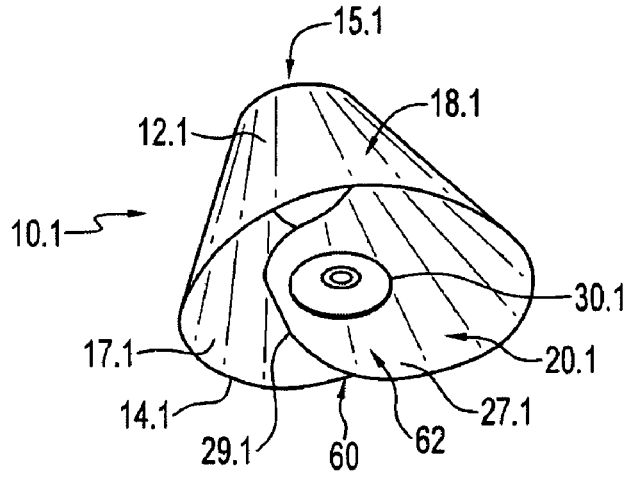
FIG. 12 is a top, front perspective view of the tie knot member according to a further embodiment of the invention.
Figure 13:
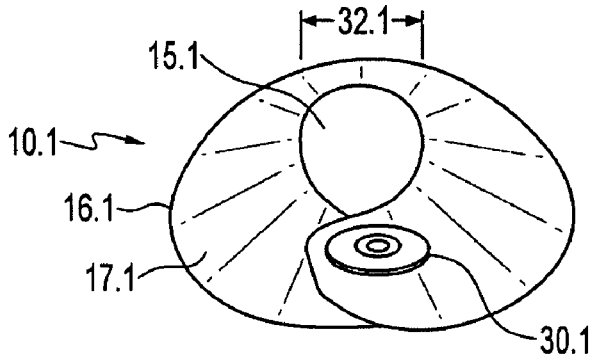
FIG. 13 is a top perspective view of the tie knot member of FIG. 12 in the first mode.
Figure 14:
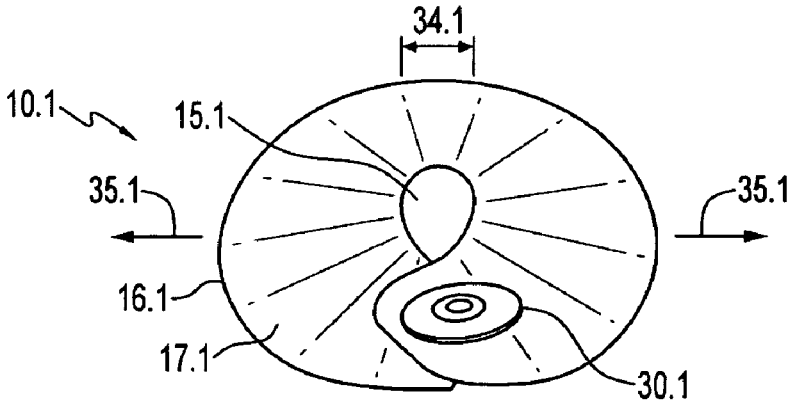
FIG. 14 is a top perspective view of the tie knot member of FIG. 12 in the second mode.

A further, preferred embodiment is illustrated in FIGS. 12 to 14, where like parts have like numbers with the addition of "0.1". Referring first to FIG. 12, the tie knot member 10.1 has opposite edge portions 60 and 62 which overlap against the shell 12.1. As a result, the opposite edges 27.1 and 29.1 do not curve inwards. The pivotal connector 30.1 is positioned at the rear portion 20.1 and thereby retains the shape of the shell 12.1 and the position of the overlapping edge portions 60 and 62. As a result, the shell 12.1 has a truncated cone-like shape and no cardioid shape or guiding member is present or required.

In use, the tie knot member 10.1 functions similar to the previously described embodiment and therefore will not be described in great detail. FIG. 13 illustrates the first, non-actuated mode, where the lower aperture 15.1 has a diameter 32.1. In FIG. 14, the force indicated by arrow 35.1 is applied outwardly by the wearer's fingers adjacent to the upper aperture 17.1 to spread the shell 12.1 at its upper end 16.1 and achieve the second, actuated mode. As a result, the upper aperture 17.1 is enlarged and the lower aperture 15.1 is reduced to diameter 34.1.

The pivotal connector 30.1 in this example is a rivet that compresses the opposite edge portions 60 and 62 so as to further promote the frictional retention of either the non-actuated mode or the second actuated mode of the tie knot member 10.1.

In view of all of the above, the tie knot member of the present invention has many advantages. The installation of the tie knot member is easy and fast. It consistently provides the appearance of a perfectly tied tie and the effect takes only seconds to achieve. The invention is also very simple from a manufacturing perspective and can easily be adopted and manufactured by all tie manufacturers with very littler capital equipment or additional labor costs. An equally important feature of this invention is that the tie knot member may be color coordinated or contrasted to one's personal tastes. For example, a tie may be used of one color, and a tie knot member of a completely different color. As a result, a collection of multiple ties may be collected so as to effectively serve to create a mix and match wardrobe of ties and tie knot member for color and fabric coordinating. Alternatively, the tie knot member may be made of a clear material.

Those skilled in the art will appreciate that other variations are possible which provide a pivotal connector, and which enable the expansion of an upper aperture and the restrictive reaction of a lower aperture. Changes made during the development process of this invention whether for purpose of fashion, manufacturing ease, usage convenience or operational enhancement will be easily identified by the average person now that the invention is has been disclosed and understood and will only add to the merits of the invention over time. The illustrations of the tie knot member of FIGS. 1 to 14 are merely by way of illustration of the invention and are no way intended limit variations afforded by the invention. For example, the tie knot member could be made wider towards the upper end 16 and narrower towards the base end 14, or just made wider at the upper end 16 with the lower aperture 15 remaining much the same.

It will be appreciated that the material to be used for the tie knot member will have an effect on the preferred location for the pivotal connector.

Referring to FIG. 1, the upper end 16 may be folded over where it abuts the front portion 18. Put another way, the shell 12 may be lapped at the upper end 16 where it abuts the front portion 18. Such a folded edge could provide additional friction to inhibit the tie knot member 10 from inadvertently sliding down or rotating on the tie 46. Likewise, if the bottom edge at the base end 14 was folded up where it abuts the front portion 18, the two opposing edges could work together to effectively restrict the tie knot member 10 from movement in any direction.

Regarding the method of installing the tie knot member, the over and under tying procedure of step 3 may be modified from one wrap to two if desired. By using this alternative tying method, the forces needed to adjust the tightness or looseness of the tie and tie knot member are increased, therefore making the tie more resistant to inadvertently coming loose. This is due to the additional friction created from the additional contact area between the tie knot member and tie created from the additional wrap.

One may attach the tie knot member at the flared portion 48 abutting the neck portion 52 by separating the pivotal connector 30 illustrated in FIG. 5, wrapping the shell 12 around the tie 46, and then reconnecting the pivotal connector so as to provide for quick and easy positioning of the tie knot member.

The pivotal connector may be used to adjust the size of the knot formed by the tie knot member. For example, this may be possible if the pivotal connector is in the form of hook and loop fastener.

Regarding the actuation of the tie knot member, this may be done by extending the upper aperture 17 outwards, compressing the lower aperture 15 inwards, or with other similar variations that cause the upper aperture 17 to expand and lower aperture 15 to contract.

It will be understood by someone skilled in the art that many of the details provided above are by way of example only and are not intended to limit the scope of the invention which is to be determined with reference to the following claims.

What is claimed is:

1. A tie knot member for an elongated strip of fabric, the tie knot member comprising:

a shell having a truncated, conical shape with a cardioid-like cross-section, the shell having a base end with a lower aperture, a top end with an upper aperture, and a rear portion extending between the base end and the top end, the rear portion including a cusp; and a pivotable connector connecting the shell across the cusp, the pivotable connector being so positioned to retain the shape of the shell and allow pivoting action around the pivotable connector that results in a restricting reaction at the lower aperture of the shell, whereby when the elongated strip of fabric is passed through the shell and the shell is spread at the top end, the upper aperture is enlarged and the lower aperture is reduced, thereby cinching the lower aperture against the elongated strip of fabric.

2. The tie knot member as claimed in claim 1, wherein the cusp is pointed internally with respect to the shell.

3. The tie knot member as claimed in claim 1, wherein the rear portion includes a slit at the cusp.

4. The tie knot member as claimed in claim 3, wherein the pivotable connector connects the shell across the slit.

5. The tie knot member as claimed in claim 1, wherein the shell has a front portion opposite the rear portion.

6. The tie knot member as claimed in claim 5, wherein the shell has a front portion opposite the rear portion, the front portion being shaped as a planar curve.

7. The tie knot member as claimed in claim 1 wherein the pivotable connector is disposed half way between the lower aperture of the shell and the upper aperture of the shell.

8. The tie knot member as claimed in claim 1 wherein the pivotable connector is disposed such that the distance between the pivotable connector and the upper aperture of the shell is longer than the distance between the pivotable connector and the lower aperture of the shell.

9. A tie knot member for an elongated strip of fabric, the tie knot member comprising:

a shell in the shape of two truncated, partial cones, the two truncated, partial cones being longitudinally connected, the shell having a base end with a lower aperture, a top end with an upper aperture, a front portion extending between the base end and the top end, the two truncated, partial cones tangentially connecting at the front portion along a common wall, and a rear portion positioned opposite the front portion; and a pivotable connector connecting the two truncated, partial cones at the rear portion such that the shell has a cardioid-like cross-section, the pivotable connector being positioned to retain the shape of the shell and allow pivoting action around the pivotable connector that results in a restricting reaction at the lower aperture of the shell, whereby when the elongated strip of fabric is passed through the shell and the shell is spread at the top end, the upper aperture is enlarged and the lower aperture is reduced, thereby cinching the lower aperture against the elongated strip of fabric.

10. The tie knot member as claimed in claim 9, wherein the rear portion includes a slit extending from the base end and the top end.

11. The tie knot member as claimed in claim 10, wherein the slit is positioned between the two truncated, partial cones, the pivotable connector connecting the two truncated, partial cones at the slit.

12. The tie knot member as claimed in claim 9, wherein the lower aperture is so shaped as to contract inwardly when the shell is spread at the top end.

13. The tie knot member as claimed in claim 9, wherein the upper aperture is so shaped as to extend outwardly when the shell is spread at the top end.

14. The tie knot member as claimed in claim 9, wherein the base end tapers when the shell is spread at the top end.

15. The tie knot member as claimed in claim 9, wherein the pivotable connector is a fastener.

16. The tie knot member as claimed in claim 9, wherein the pivotable connector is a rivet.

17. A combination tie and tie knot member for the tie, the tie having a flared portion and a neck portion, the tie knot member comprising:

a shell having a truncated, conical shape with a cardioid-like cross-section, the shell having a base end with a lower aperture, a top end with an, upper aperture, and a rear portion extending between the base end and the top end, the rear portion including a cusp; and a pivotable connector connecting the shell across the cusp, the pivotable connector being so positioned to retain the shape of the shell and allow pivoting action around the pivotable connector that results in a restricting reaction at the lower aperture of the shell, whereby when the flared portion of the tie is passed through the shell and the shell is actuated outwards at the top end and against the neck portion of the tie, the upper aperture is enlarged and the lower aperture contracts, thereby cinching the lower aperture against the flared portion of the tie.

18. The combination tie and tie knot member as claimed in claim 17, wherein the rear portion of the tie knot member includes a slit extending from the base end and the top end.

19. The combination tie and tie knot member as claimed in claim 17, wherein the lower aperture of the tie knot member is so shaped as to extend inwardly against the flared portion of the tie when the shell is actuator outwards at the top end, the tie knot member.

20. The combination tie and tie knot member as claimed in claim 17, the flared portion of the tie having a dimple adjacent to the lower aperture of the tie knot member when the shell is actuator outwards at the top end against the neck portion of the tie.

21. A tie apparatus for a wearer having a neck, the tie apparatus comprising:

an elongated strip of fabric; and a cinching device for cinching the strip of fabric about the neck of the wearer, the cinching device including a sheet-like flexible member having opposite edges, the flexible member being curved to form a truncated cone with an upper aperture and a lower aperture, the strip of fabric extending through the cinching device from the upper aperture to the lower aperture, and a pivotable connector operatively connecting the opposite edges of the flexible member together, the opposite edges of the flexible member forming an inwardly directed cusp, the pivotable connector being positioned to allow pivoting action around the pivotable connector that results in a restricting reaction at the lower aperture, whereby a force applied to spread the cinching device apart at the upper aperture causes the lower aperture to contract and cinch the cinching device about the strip of fabric.

* * * * *